United States Patent [19]

Eckman

[11] Patent Number: 4,714,194

[45] Date of Patent: Dec. 22, 1987

[54] HOUSING FOR WALL MOUNTED HEATING UNIT

[75] Inventor: Harold J. Eckman, Milwaukie, Oreg.

[73] Assignee: Cadet Manufacturing Company, Vancouver, Wash.

[21] Appl. No.: 754,366

[22] Filed: Jul. 11, 1985

[51] Int. Cl.[4] ..... F24H 9/02; F24D 19/06

[52] U.S. Cl. ..... 237/70; 237/79; 219/366; 165/122

[58] Field of Search ..... 219/315, 318, 322, 339, 219/342, 343, 345, 366; 237/70, 79; 165/54, 53, 55, 56, 122

[56] References Cited

U.S. PATENT DOCUMENTS

| | | | |
|---|---|---|---|
| 2,001,876 | 5/1935 | Hvoslef | 237/79 |
| 2,229,828 | 1/1941 | Wach | 219/342 |
| 4,309,594 | 1/1982 | Jones | 219/342 |
| 4,350,871 | 9/1982 | Davis, Sr. et al. | 219/343 |

*Primary Examiner*—Henry A. Bennet

*Attorney, Agent, or Firm*—Chernoff, Vilhauer, McClung & Stenzel

[57] ABSTRACT

A sheet metal housing for containing a heater unit including an electric resistance heating element and a fan for circulating air through the heating element, and for protectively supporting such a heater unit within the interior space of a vertical building wall, the housing having a pair of legs extending below a body portion which encloses the heating element and fan unit, supporting the heating element and fan unit at least a minimum distance above the base of a wall, in which either of the legs can be bent upward to a horizontal position giving the entire housing, including the horizontally extended leg, a length equal to the usual spacing between adjacent vertical studs of a wall, so that the housing can be supported at a height greater than the minimum above the base of a wall by fastening one end of the housing to a stud and fastening the outwardly extended leg to the stud near the opposite end of the housing. The upper rear wall of the body of the housing, and the rear edges of the legs, slant toward the front of the housing, making it possible to retrofit the housing into an already-existing wall, legs first, through an opening whose height is less than the height of the housing including its legs.

14 Claims, 9 Drawing Figures

HOUSING FOR WALL MOUNTED HEATING UNIT

BACKGROUND OF THE INVENTION

The present invention relates to wall-mounted electrical resistance space heaters equipped with fans, and particularly to an easily installed container for use in mounting such a space heater unit, either during construction of a wall or as a retrofit of such a heating unit into an existing wall of frame and plasterboard or similar construction.

Most previously existing electrical resistance heaters have been of the type which extend a small distance into a room along the base of the walls. Such heater units present an appearance which is not particularly attractive. They require a relatively large amount of space, because they depend upon convention to move the air over their surfaces, while they must remain at safe temperatures. Because of thier dependency on convention, the heating provided by such baseboard units is uneven.

In many situations central heating is not desirable. Particularly where the climate is mild, the installation of central heating equipment is often too expensive to be justifiable. Where there are many rooms which are used only infrequently, central heating, with a central control, results in heating of unoccupied rooms, wasting energy. In such mild climates smaller heating units controlled by local thermostats are able to provide the required amount of heat for each particular space without wasting heat by warming spaces which do not need the heat. Fans have been developed which are capable of moving air efficiently, dependably, and quietly enough to be marketably useable with efficient electrical resistance heating elements which develop temperatures on their heat-exchanging surfaces which are undesirably high for use in an exposed base-board heating location extending into a room. Such heating units are particularly well adapted for mounting within a wall, particularly well adapted for mounting within a wall, particularly an interior wall of a building, to provide a controllable amount of heat for the room into which such a unit faces.

Installation of such small, efficient, forced circulation heating units requires, for the sake of safety, that the units be spaced at least a certain minimum distance above a floor, in order to avoid fire danger. In many cases it may be desirable to mount heating units at a height significantly greater than the minimum required for safety. In either case, the heating unit must be adequately supported to prevent noisy vibration and to assure that the space heater will not easily be dislodged. Such a space heater should be capable of being installed easily within an already-existing wall, as well as being installed during construction of a wall. Additionally, retrofit into an already-existing wall should be possible without having to repair wall coverings as a result of the installation.

Additionally, the outer surfaces of a housing must not become too hot for safety as a result of absorbing heat from the space heater enclosed in it. This has been a problem in previous housings having a generally rectangular box-like shape.

Housings previously available for such heaters have been undesirably expensive, have required measurements to assure sufficient installation height, and have required installation of shims and spacers to locate the housings properly.

What is needed, then, is a suitable housing for such a unit which will facilitate safe installation, either at a minimum height in a wall or at higher locations, which will result in an attractive appearance of the installed heating unit, which may be retrofitted into existing walls, which results in efficient heating of room air without overheating of the housing, and which is relatively inexpensive to manufacture.

SUMMARY OF THE INVENTION

The present invention meets the need which has existed for a housing suitable for an efficient electrical resistance space heater, by providing a sheet metal housing of two-piece construction, including a body for protectively enclosing a fan, its motor, and an electrical resistance heating element. The housing supports the heating element and may easily be fastened securely to the frame structure within a wall of a building to be heated. A mouth which opens into the space to be heated provides for both intake and discharge of air.

A pair of opposite end walls of the housing include holes through which appropriate fasteners may be installed to fasten either end of the housing to a vertical member of the frame of the wall. Legs extend downward below the body, to ensure at least a minimum spacing between the heating element and the floor of the room. The legs provide direct support for the body and an enclosed heating element and fan, assuring that the heating unit is located no lower than its minimum safely allowable height, while one end of the housing is fastened to a vertical frame member of the wall to provide stability.

Alternatively, to mount the housing at a greater height, one end may be fastened to a vertical frame member of the wall and the leg at the opposite or second end of the housing may be bent upwardly to a horizontal position in which the leg fills the space remaining between the second end of the housing and an adjacent vertical structural member of the wall.

The two legs are tapered from a maximum front-to-rear depth adjacent the bottom of the portion of the body to a minimum depth at the bottom end of each leg, in a preferred embodiment of the invention. While the front of each leg extends generally vertically, so that it can rest against the interior side of the sheathing of a wall, the rear edges of the leg extend slopingly forward and downward, to provide sufficient clearance for insertion of the housing of the invention through a hole cut in a pre-existing wall.

An upper rear portion of the body of the housing slopes upward and forward from the back wall of the body, helping to reduce the required size of a hole through the wallboard of a pre-existing wall in order for the housing of the invention to be installed. This sloping upper rear wall portion also promotes natural circulation of air around a heating element, keeping the housing itself from becoming overheated.

It is therefore a primary object of the present invention to provide an improved housing for an electrical resistance heating element and a motor-driven circulating fan, so that they may be installed safely and attractively within a frame wall of a building.

It is another object of the present invention to provide a housing which establishes a safe location for the heating element of an electrical resistance space heater and provides required support for the heating element and its associated fan and motor, either in a location at a minimum height, or at a higher location.

It is yet a further object of the present invention to provide a housing for an electrical resistance space heater which can be used to install such a space heater easily, either during new construction of a wall or in retrofitting such a space heater into an already-existing wall of frame construction.

A primary feature of the heater housing of the present invention is the provision of a pair of legs which extend downwardly at opposite ends of the body of the housing to support an electrical resistance space heater at no less than a minimum height, and which may be bent to extend horizontally from an end of the housing to a nearby wall stud while the opposite end of the housing is attahced to another wall stud.

A further feature of the present invention is its two-piece construction, incorporating a body which is assembled without welding and a front rim which latchingly mates with the body, holding it together to provide an easily-constructed yet sturdy housing for an electrical resistance space heater.

It is a principal advantage of the space heater housing of the present invention that it is more easily installed, during construction of a building wall, than previously available housings for electrical resistance space heaters.

It is another advantage of the space heater housing of the present invention that it is less expensive to construct than previously known types of housings for similar purposes.

It is yet further advantage of the space heater housing of the present invention that its shape promotes natural flow of air to cool the surfaces of the housing adequately and thus prevent hazardous increases in temperature of the housing.

The foregoing and other objectives, features, and advantages of the present invention will be more readily understood upon consideration of the following detailed description of the invention taken in conjunction with the accompanying drawings.

DETAILED DESCRIPTION OF THE INVENTION

Figure 1:
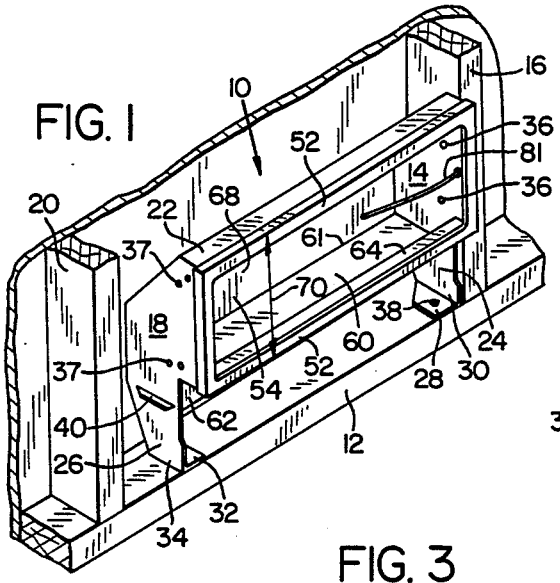
FIG. 1 is a perspective view of a space heater housing embodying the present invention, showing the housing supported on its legs stop the plate of a partially-constructed interior wall of a building.

Referring now to the drawings, a housing 10 embodying the present invention is shown in FIG. 1 resting atop a plate member 12 of stud frame wall not yet covered with plasterboard. The right end wall member 14 of the housing alongside a stud 16, while the left end wall member 18 of the housing is spaced a small distance away from a stud 20. The housing includes a body portion, indicated generally as 22, and a pair of legs 24 and 26 extend downwardly beneath the body 22, as extensions, respectively, of the right end wall 14 and left end wall 18. A foot 28 extends horizontally inward beneath the body 22 from the bottom end 30 of the leg 24. A symmetrically oppositely located foot 32 extends inwardly from the bottom end 34 of the leg 26. Thus the legs 24 and 26 support the body 22, which is preferably fastened securely to the stud 16 by fasteners such as nails 36 driven through holes 37 provided in the right end 14. The combined height of the plate 12 and the legs 24 and 26 support the housing 10 at the proper height to meet building code requirements for spacing of heating units above the floor of a dwelling house.

Figure 2:
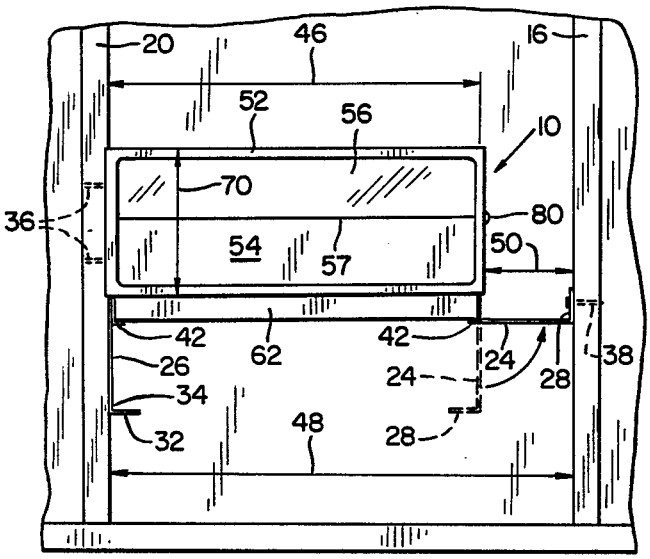
FIG. 2 is a front elevational view of the housing shown in FIG. 1, showing the manner of mounting the housing at a greater height than that shown in FIG. 1.

An alternative mode of mounting the housing 10 of the present invention is shown in FIG. 2. In FIG. 2, the housing 10 is spaced a greater distance above the plate 12, and the left end 18 is mounted flush against the stud 20. The right leg 24, however, has been bent upwardly to a horizontal position from its original position shown in broken line, and a nail 38 or other appropriate fastener extends through a hole 39 provided in the foot 28 to fasten it to the stud 16.

Figure 3:
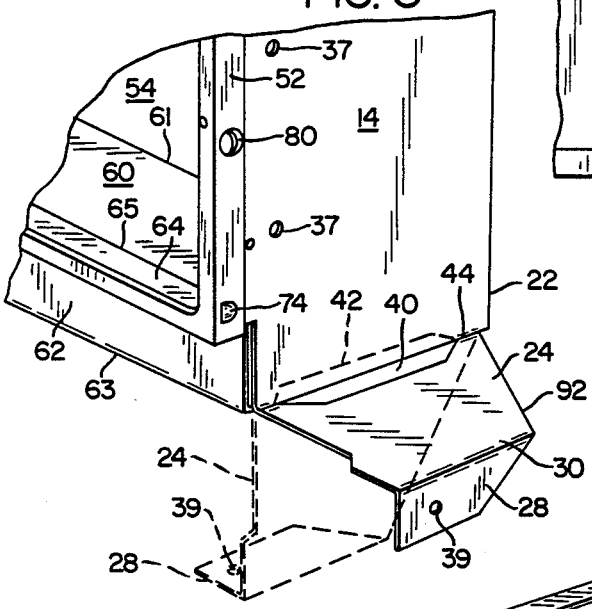
FIG. 3 is a perspective detail view of a portion of the housing shown in FIG. 2, including one leg extended as a lateral support member.

As shown in detail in FIG. 3, the construction of the end walls 14 and 18 facilitates bending the legs 24 and 26 to a horizontal position. A cut 40 through the sheet metal of each of the ends 14 and 18 defines a respective bottom support flap 42 which extends horizontally inwardly from each of the ends 14 and 18. The relatively small amount of material remaining at each end of the cut 40 defines a bend line 41 which extends horizontally, parallel with the intersection of the bottom end 30 or 34 and the respective foot 28 or 32.

The body 22 has a length 46 defined by the end walls 14 and 18, which is, for example, $12\frac{3}{8}$ inches, and which is thus some 2 inches less than the standard spacing 48 of $14\frac{3}{8}$ inches between the nearest surfaces of the studs 16 and 20 of a wall of frame construction with vertical studs at the normal 16 inch center-to-center spacing used to conform with standard $4\times8$ foot panels of wallboard material. The legs 24 and 26 each define a spacer distance 50 between the bend line 44 and the respective bottom end 30 or 34, which is equal to the difference (in this case 2 inches) between the length 46 and the standard spacing 48.

Figure 5:
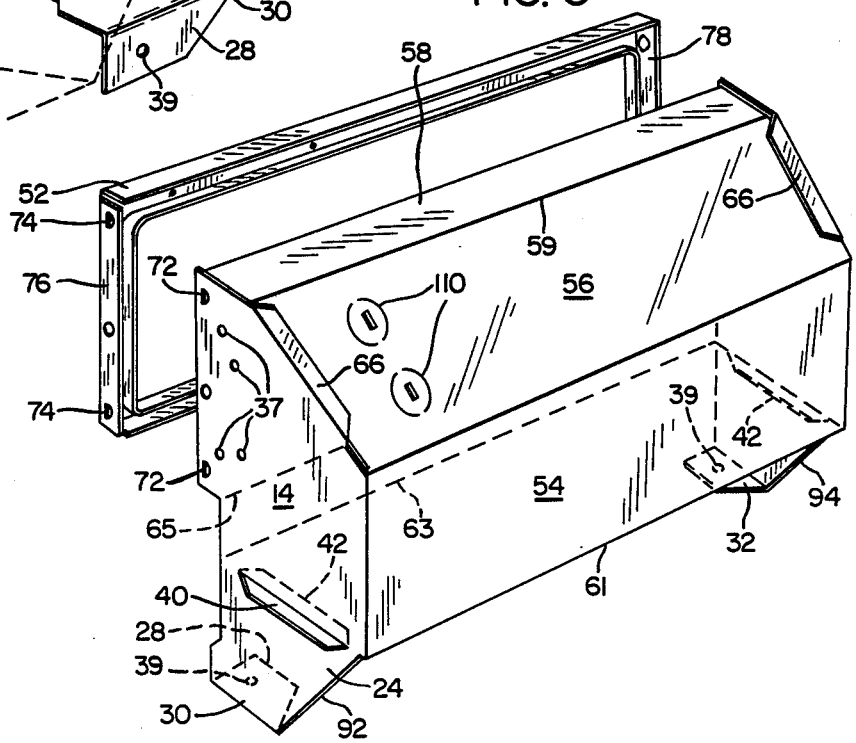
FIG. 5 is a perspective view taken from the upper right rear of the housing shown in FIG. 1.
Figure 6:
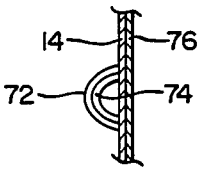
FIG. 6 is a detail view showing the manner of attachment of the front rim to the body of the housing shown in FIG. 1.
Figure 4A:
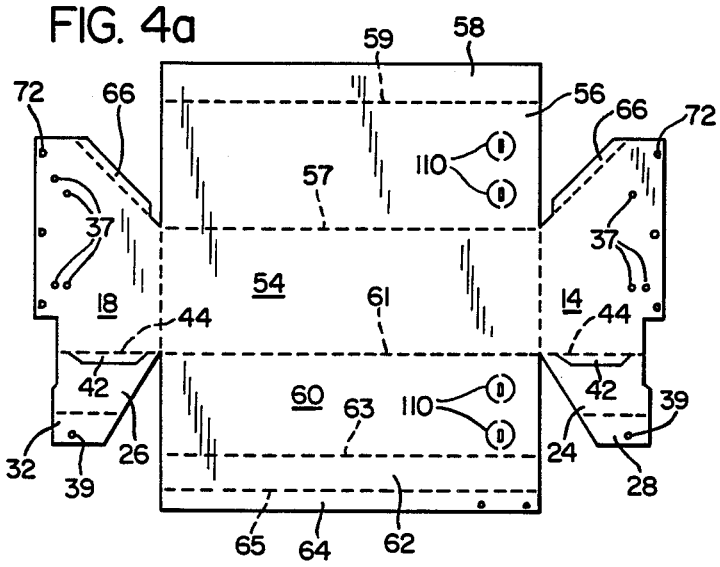
FIG. 4*a* is a view showing the shape of a sheet of material which can be folded to form the body of the housing shown in FIG. 1.
Figure 4B:
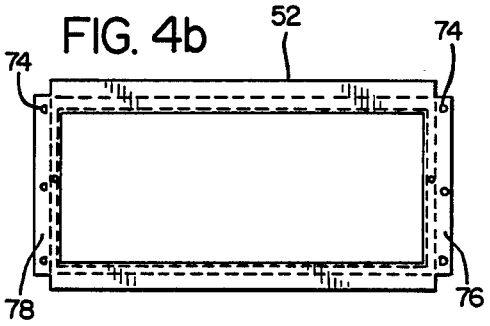
FIG. 4*b* is a view of the shape of a sheet of material which can be folded to form the front rim of the housing shown in FIG. 1.

As will be appreciated upon referring additionally to FIGS. 4*a*, 4*b*, and 5, the body 22 of the housing may be constructed of a single sheet of metal, for example, 20-gauge sheet steel, cut and bent to shape. The body is held in that shape, without the need for any welding, by a front rim 52.

A back wall 54 is the central portion of the body 22. An upper rear wall 56 extends upwardly from the back wall 54, to which it is connected along a bend line 57. A top member 58, connected along a bend wall 56 along a bend line 59, extends forward from the upper rear wall 56. A bottom member 60 extends forwardly from a bend line 61 located along the bottom of the back wall 54 when the body 22 is assembled, and a front wall 62 extends upwardly from the front edge bend 63 of the bottom member 60. A front lip 64 extends forwardly from the top edge 65 of the front wall 62, generally parallel with the bottom member 60.

The right end 14 and left end 18 extend forward, parallel with one another, from respective bend lines defining the ends of the back wall 54. Each of the ends 14 and 18 has connected therewith an upper flap 66 which extends inwardly toward the opposite end of the housing 10, as may be seen in FIG. 5. The upper flaps 66 are located on the exterior of the upper rear wall 56, maintaining it in the proper orientation with respect to the back wall 54.

The top member 58 and front lip 64 extend horizontally forward parallel with one another, and the front marginal portions of the top member 58, front lip 64, right end 14 and left end 18 all fall in a common, vertical plane, defining a front mouth 68 having a mouth height 70 which is great enough to accept a blower and heating element unit within the body 22 and provide ample area for intake and exhaust of air to be heated by the unit.

The front rim 52 slides matingly over the marginal portions, and is retained in place by mating engagement of respective latching portions 72 and 74 located respectively on the end walls 14 and 18 and on the end flaps 76 and 78 of the front rim 52. The female latching portions 72 may each be an indentation bounded by a forwardly located vertical slit through the material of the respective end 14 or 18, and the male mating portions 74, located on the end flaps 76 and 78, are of similar construction, protruding inwardly and of a size to neat sungly within the indentations 72 of the ends 14 and 18. The front rim 52 is further attached to the body 22 by a screw 80, or other similar fastener extending through correspondingly located apertures in the right end flap 78 and right end 14 and used to attach a grounding wire 81 for electrically grounding the housing 10.

Figure 7:
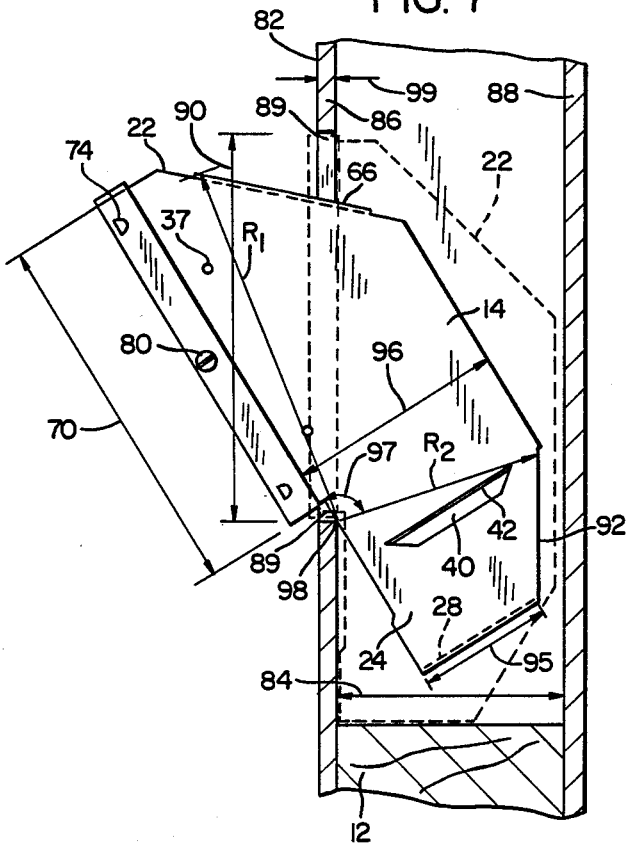
FIG. 7 is a right end view of the housing shown in FIG. 1, together with a sectional view of an interior frame wall, showing the manner of retrofit installation of the housing in a pre-existing wall.

An important feature of the housing 10 is its ability to be retrofitted into an already-existing wall, As may be seen in FIG. 7, the housing 10 may be installed in a conventional wall 82 having an interior cavity depth 84, between sheets 86 and 88 of wallboard mounted in the normal fashion. A heater installation opening 89 cut through the sheet 86 of wallboard need only have an opening height 90 slightly more than the mouth height 70, because the rear edges 92 and 94 of the legs 24 and 26 extend slopingly forward and downward toward the bottom ends 30 and 34, so that the feet 28 and 32 extend over a front-to-rear distance 95 which is less than the entire body depth 96 of the body 22 between the hack wall 54 and front wall.62. Additionally, the forward slope of the upper rear wall 56, extending over about three fourths of the depth 96 of the body 22 at an angle of about 45°, provides clearance in combination with the sloping rear edges 92 and 94, to allow insertion of the housing 10 through the opening 89, with the legs 24 and 26 preceding the remainder of the housing 10.

The legs 24 and 26 may be inserted through the opening 89, with the housing 10 tilted forward, until the upper rear wall 56 is within the opening 89, with the front wall 62 resting on the edge of the wallboard 86 at the bottom of the opening 89, as shown in solid line. Thereafter, the housing 10 may be slid into the cavity of the wall while being rotated to its normal upright position with the back wall 54 parallel with and adjacent the interior surface of the wallboard 88, and with the front marginal portions of the top member 58, front lip 64, and right and left ends 14 and 18, together with the front rim 52, extending through the opening 89 approximately flush with the outer surface of the wall 82, as shown in broken line. With the opening 89 properly located, the feet 28 and 32 will be supported by the plate 12, and appropriate fasteners may be used to secure either the right end 14 or left end 18 to an adjacent stud member of the wall 82. Thus, the shape of the housing 10 permits retrofit installation even though the overall height of the housing 10, including the height of the legs and any portion of the body 22 extending downward beneath the mouth 68, is greater than the height 90 of the opening 89.

Such installation is made possible by the forward slope of the rear edges 92 and 94 and the forward slope of the upper rear wall 56, which fall within an envelope of shapes permitting the housing 10 to pivot about a horizontal pivot axis 98 located adjacent the edge 65 of the front wall 62 or at any position along the front wall 62 during installation of the housing 10, as the front wall 62 rests on the lower edge of the opening 89 during installation. Thus the housing 10 will be able to fit through an opening 89 having an opening height 90, into a wall 82 having the interior cavity depth 84, if for any location of the horizontal pivot axis 98 along the front of the housing 10 and below the intersection of the front wall 62 and front lip 64, the distance to the furthest point of the housing in the direction which is horizontal when the housing 10 is in an installed, upright position is no greater than the interior depth 84, and the distance from that same location of the horizontal pivot axis 98 to any portion of the housing 10, in a direction 90° above every such direction of measurement, is less than the mouth height 70, assuming the thickness 99 of the sheathing material or wallboard 86 is negligible. As may be seen from another viewpoint, for every point on the top member 58 which has to pass through the opening 89, and for every part of the upper rear wall 56 and the back wall 54, there is a pivot axis 98 exterior of the housing and forward of the legs 24 and 26, located at a distance equal to the mouth height 70 as indicated by the arrow R1, and the distance from such a pivot axis 98, in the direction of the arrow R2, to the rear edge 92 or 94, respectively, is less than the cavity depth 84 of the wall 82. The direction of the arrow R2 is separated from that of the arrow R1 by an angle 97 equal to 90° plus the angle whose tangent is equal to the wallboard thickness 99 divided by the opening height 90. Thus, for wallboard 86 $\frac{5}{8}$ inch thick and an opening whose height 90 is $5\frac{7}{8}$ inches, the angle 97 is about 95.2°.

As a result, the housing 10 of the present invention can be installed through an opening 89 of substantially the same size as the mouth of the housing 10, making it unnecessary to cut a substantially larger hole and repair the opening after installation of the housing 10.

Figure 8:
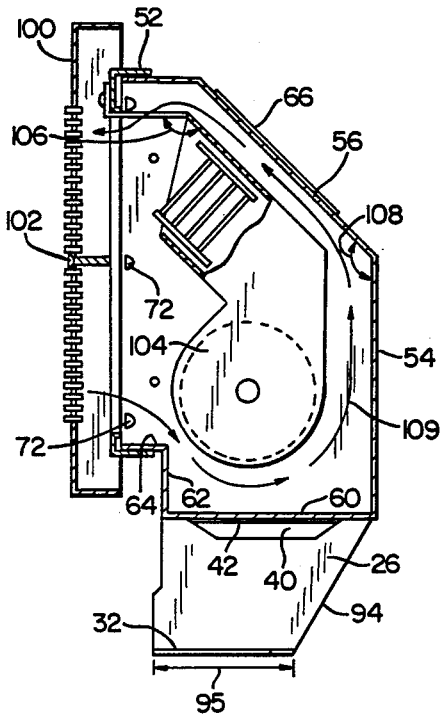
FIG. 8 is a sectional end view of the housing shown in FIG. 1, showing the relationship between the housing and an installed heater and fan unit within the housing.

The sloping orientation of the upper rear wall 56 serves an additional purpose, as may be seen in FIG. 8. A register 100 can be attached to the front rim 52 by a pair of screws 102 to cover the mouth 68 of the housing attractively, direct air flow properly, and simultaneously hide any difference in size between the opening 89 and the mouth 68 of the housing 10. A blower and heating element combination 104 fits within the housing 10, and the angle 106 of deflection of air exiting from the heating element will be about 135°, thus providing a smooth flow of air exiting from the heating element through the register 100. Similarly, the angle 108 will be about 135°, so that the flow of air indicated by the arrow 109 around the blower and heating element 104 is encouraged by convection, thus avoiding undesirable increased temperature of the upper rear wall 56 and top member 58 which would otherwise be caused by poor circulation of air around the blower and heating element 104. A small space for air circulation between the front wall 62 and the interior of a building wall is provided by the forward extension of the lower part of the front of each leg 24 and 26. A suitable heating element and fan combination 104 of unitized construction including a zig-zag type heating element suspended in mica, together with a tangential blower driven by an electric motor, is manufactured by Cadet Manufacturing Company of Vancouver, Wash. and is available as heating unit model No. ZA-051.

Appropriately located knock-out holes 110 are preferably provided to permit connection of power cables into the housing 10 to supply power for the blower and heating element 104.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A sheet metal housing for a heating unit, suitable for mounting within a building wall of frame construction including generally vertical members separated from one another within said building wall by a standard spacing, the housing comprising:

(a) a body including an upright back wall;

(b) a bottom member extending generally forward from said back wall;

(c) a pair of opposite upright end walls extending generally forward from said back wall, said end walls defining a body length which is less than said standard spacing;

(d) a respective leg extending downwardly beneath said bottom member as an extension of each of said end walls, each said leg including a bottom end; and (e) means associated with at least one said leg for defining at least one bend line thereon, said at least one bend line defining a spacer distance extending along the respective leg a distance equal to the difference between said body length and said standard spacing, so that when said respective leg is bent along said bend line, and a portion of said leg is thereby placed in a horizontal position, said body length and said portion together extend over a distance equal to said standard spacing.

2. The housing of claim 1 wherein said upright end walls are substantially parallel with each other and each said bend line is substantially horizontal.

3. The housing of claim 1 wherein said end walls are substantially parallel with each other and extend perpendicularly forward from said back wall, said means for defining at least one bend line including an opening extending through said at least one of said legs and defining a bottom support flap extending laterally beneath said bottom member.

4. The housing of claim 1, including a respective foot located at the bottom end of each of said legs, each said foot comprising a continuation of the material of the respective leg extending generally horizontally toward the opposite one of said legs.

5. The housing of claim 4 wherein said end walls are substantially parallel with one another and wherein said end walls and said feet each define at least one fastener hole extending therethrough.

6. The housing of claim 1 wherein each of said legs extends downward a predetermined distance beneath the location of said bottom member, so as to support said housing at a position providing a predetermined vertical spacing between said heating unit and a horizontal surface supporting said legs.

7. The housing of claim 1 including a horizontal top member and an upper rear wall portion extending slopingly forward and upward from said back wall toward said top member.

8. The housing of claim 7, said upper rear wall, said top member, upright end walls, legs, and bottom member all being formed of a unitary piece of sheet material, and said upright end walls, bottom member, and upper rear wall all being integrally joined with said back wall, and said top member, upright end walls, and bottom member each having a respective front marginal portion, said front marginal portions thereof cooperatively defining a mouth, said housing further including a front rim extending around the exterior of said marginal portions defining said mouth, and said front rim and each of said end walls including a respective plurality of mating retainer parts retaining said front rim in said position surrounding said front marginal portions.

9. The housing of claim 1 wherein each of said legs includes a rear edge, the portion of said rear edge closest to said bottom of said leg being located a predetermined distance forward of said back wall, so as to facilitate inserting said housing into a cavity within a building wall.

10. The housing of claim 9, further including a horizontal top member and means for defining a mouth having a predetermined mouth height, and further including means for defining a pivot axis extending horizontally beneath said front opening, said body having a predetermined depth and said pivot axis being located forward of said back wall a distance no greater than an interior depth of said building wall and said rear edge of each said leg being so located that said housing can be inserted into the space within said wall through an opening in said wall having an opening height greater than said height of said front opening but less than the distance between said bottom member and said top member by inserting said legs into said building wall through said opening and thereafter tilting said housing about said pivot axis to an upright position.

11. A sheet metal housing for a heating unit, suitable for mounting within a building wall, the housing comprising:

(a) a body of sheet metal including an upright back wall;

(b) a bottom member extending forward from said back wall;

(c) an upper rear wall extending slopingly forward and upward from said back wall;

(d) a horizontal top member extending forward from said upper rear wall;

(e) a pair of opposite upright end walls extending forward from said back wall;

(f) a pair of legs extending downwardly beneath said bottom member as a respective extension of each of said end walls;

(g) said upper rear wall, said top member, said upright end walls, said legs, and said bottom member all being formed integrally of a unitary piece of sheet metal, and said top member, upright ends, and bottom member each having a respective front marginal portion, said front marginal portions thereof cooperatively defining a mouth; and (h) a front rim extending around the exterior of said front marginal portions defining said mouth, and said front rim and each of said end walls including a respective plurality of mating retainer parts retaining said front rim in said position surrounding said front marginal portions, said housing thereby being held together free of any welded joints.

12. The housing of claim 11, further comprising a respective upper rear flap extending from each and wall toward the opposite end wall, above said upper rear wall, and a respective bottom support flap extending horizontally from each end wall beneath said bottom member.

13. A housing for a heating unit including a heating element and a fan, for mounting said heating unit within an already-existing building wall of frame construction having a pair of apart-spaced sheets of sheathing material located on respective opposite sides of said wall, one of said sheets of sheathing material defining an opening having an opening height, and there being a cavity having a cavity depth between said sheets of sheathing material, said cavity depth being less than said opening height, the housing comprising:

(a) a body including a generally vertical back wall;

(b) an upper rear wall extending slopingly forward and upwardly from said back wall;

(c) a generally horizontal top member extending forwardly from said upper rear wall;

(d) a bottom member extending generally forward from said back wall and defining a body height, between said bottom member and said top member, which is greater than said opening height;

(e) a pair of legs extending downwardly beneath said bottom member;

(f) means for defining a mouth extending forward from said body, said mouth defining a mouth height smaller than said opening height but greater than said cavity depth;

(g) said legs including rear portions thereof shaped so as to facilitate insertion into said cavity in said wall through said opening, by first inserting said legs and thereafter moving said housing so as to extend said legs downward within said cavity below said opening, while rotating said body to an upright attitude; and (h) said body including means defining a body length and said opening being at least as wide as said body length.

14. A housing for a heating unit including a heating element and a fan, for mounting said heating unit within an already-existing building wall including an interior cavity having a cavity depth and including a layer of sheathing having a predetermined sheathing thickness, said layer of sheathing defining an opening therein, said opening having an opening height greater than said cavity depth, by inserting said housing through said opening, the housing comprising;

(a) a body including an upright back wall;

(b) a bottom member extending forward from said back wall;

(c) an upper rear wall extending slopingly forward and upward from said back wall;

(d) a horizontal top member extending forward from said upper rear wall and defining a body height, between said bottom member and said top member, which is greater than said opening height;

(e) a forwardly open mouth located below said top member;

(f) front means located below said mouth for defining a forwardmost location of said housing within a wall cavity;

(g) a pair of legs extending downward and located below said mouth, said pair of legs defining a front side of said pair of legs located no further forward than said front means;

(h) said body having a depth, rearward of said front means, which is less than said cavity depth of said interior cavity of said wall; and (i) said legs including rear edge means for defining the shape of said legs, wherein for each part of said upper rear wall, top member, and back wall there exists a respective pivot axis located forward of said housing and located spaced apart from said part in a first direction therefrom and at a distance therefrom no greater than said mouth height, and for every such pivot axis the distance to said rear edge means is no greater than said cavity depth, in a second direction differing from said first direction by an angle equal to 90° plus the angle whose tangent equals said sheathing thickness divided by said opening height.

* * * * *

REEXAMINATION CERTIFICATE (1100th)

United States Patent [19] [11] B1 4,714,194

Eckman [45] Certificate Issued Jul. 11, 1989

[54] HOUSING FOR WALL MOUNTED HEATING UNIT

[75] Inventor: Harold J. Eckman, Milwaukie, Oreg.

[73] Assignee: Cadet Manufacturing Co., Vancouver, Wash.

Reexamination Request:
No. 90/001,476, Mar. 28, 1988

Reexamination Certificate for:

| | |
|---|---|
| Patent No.: | **4,714,194** |
| Issued: | **Dec. 22, 1987** |
| Appl. No.: | **754,366** |
| Filed: | **Jul. 11, 1985** |

[51] Int. Cl.[4] ..... F24H 9/20; F24D 19/06

[52] U.S. Cl. ..... 237/70; 237/79; 219/366; 165/122

[58] Field of Search ..... 219/315, 318, 322, 339, 219/342, 343, 345, 366, 370; 237/70, 79; 165/54, 53, 55, 56, 122

[56] References Cited

U.S. PATENT DOCUMENTS

| | | | |
|---|---|---|---|
| 3,111,573 | 11/1963 | Crowe et al. | 219/370 |
| 3,331,940 | 7/1967 | Reid, Jr. | 219/203 |
| 3,590,218 | 6/1971 | Steiner | 219/370 |

FOREIGN PATENT DOCUMENTS

| | | | |
|---|---|---|---|
| 2364412 | 9/1977 | France | 219/366 |

*Primary Examiner*—Henry Bennett
*Attorney, Agent, or Firm*—Chernoff, Vilhauer, McClung & Stenzel

[57] ABSTRACT

A sheet metal housing for containing a heater unit including an electric resistance heating element and a fan for circulating air through the heating element, and for protectively supporting such a heater unit within the interior space of a vertical building wall, the housing having a pair of legs extending below a body portion which encloses the heating element and fan unit, supporting the heating element and fan unit at least a minimum distance above the base of a wall, in which either of the legs can be bent upward to a horizontal position giving the entire housing, including the horizontally extended leg, a length equal to the usual spacing between adjacent vertical studs of a wall, so that the housing can be supported at a height greater than the minimum above the base of a wall by fastening one end of the housing to a stud and fastening the outwardly extended leg to the stud near the opposite end of the housing. The upper rear wall of the body of the housing, and the rear edges of the legs, slant toward the front of the housing, making it possible to retrofit the housing into an already-existing wall, legs first, through an opening whose height is less than the height of the housing including its legs.

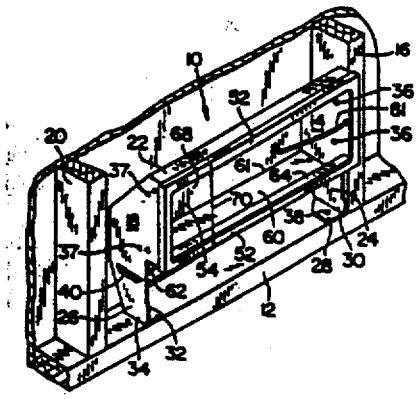

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 3–5 and 8–14 is confirmed.

Claims 1, 2, 6 and 7 are cancelled.

* * * * *